US010680323B2

(12) United States Patent
Zhang et al.

(10) Patent No.: US 10,680,323 B2
(45) Date of Patent: Jun. 9, 2020

(54) BROADBAND DUAL-BAND BASE STATION ANTENNA ARRAY WITH HIGH OUT-OF-BAND ISOLATION

(71) Applicant: South China University of Technology, Guangzhou, Guangdong Province (CN)

(72) Inventors: Xiuyin Zhang, Guangdong Province (CN); Chengdai Xue, Guangdong Province (CN); Yufeng Wu, Guangdong Province (CN)

(73) Assignee: SOUTH CHINA UNIVERSITY OF TECHNOLOGY, Guangzhou (CN)

( * ) Notice: Subject to any disclaimer, the term of this patent is extended or adjusted under 35 U.S.C. 154(b) by 0 days.

(21) Appl. No.: 16/305,045

(22) PCT Filed: Nov. 20, 2017

(86) PCT No.: PCT/CN2017/111889
§ 371 (c)(1),
(2) Date: Nov. 27, 2018

(87) PCT Pub. No.: WO2018/214424
PCT Pub. Date: Nov. 29, 2018

(65) Prior Publication Data

US 2019/0280377 A1 Sep. 12, 2019

(30) Foreign Application Priority Data

May 26, 2017 (CN) ..... 201710383966

(51) Int. Cl.
*H01Q 1/52* (2006.01)
*H01Q 5/371* (2015.01)
(Continued)

(52) U.S. Cl.
CPC ..... *H01Q 1/523* (2013.01); *H01Q 1/246* (2013.01); *H01Q 1/36* (2013.01); *H01Q 1/38* (2013.01);
(Continued)

(58) Field of Classification Search
CPC ... H01Q 21/0006; H01Q 21/062; H01Q 21/26
See application file for complete search history.

(56) References Cited

U.S. PATENT DOCUMENTS

2014/0139387 A1* 5/2014 Jones ..... H01Q 21/30 343/794
2016/0190869 A1* 6/2016 Shao ..... H02J 50/20 307/149
2016/0322713 A1 11/2016 You et al.

FOREIGN PATENT DOCUMENTS

CN 102800929 A 11/2012
CN 102868017 A 1/2013
CN 107134639 A 9/2017

OTHER PUBLICATIONS

China Patent Office International Search Authority, International Search Report dated Jan. 29, 2018 in International Patent Application No. PCT/CN2017/111889, 11 pages.

* cited by examiner

*Primary Examiner* — Daniel Munoz
(74) *Attorney, Agent, or Firm* — Masuvalley & Partners

(57) ABSTRACT

The invention discloses a broadband dual-band base station antenna array with high out-of-band isolation, having at least one high-frequency antenna unit, one low-frequency antenna unit and a floor; when there is one high-frequency antenna unit, it is placed on one side of the floor; when there are more than one high-frequency antenna units, they are placed on both sides of the floor. The high-frequency antenna unit includes multiple dipole arms and a balun,
(Continued)

wherein the dipole arms are connected by distributed inductor and fed through the balun; the low-frequency antenna unit including multiple dipole arms and a balun is placed on the middle of the floor, wherein the dipole arms are connected by distributed capacitor and fed through the balun. The balun is provided with a feeder and a H-shape microstrip line. The H-shape microstrip line connects with the feeder.

9 Claims, 5 Drawing Sheets

(51) Int. Cl.

| | |
|---|---|
| ***H01Q 1/24*** | (2006.01) |
| ***H01Q 21/00*** | (2006.01) |
| ***H01Q 21/06*** | (2006.01) |
| ***H01Q 21/26*** | (2006.01) |
| ***H01Q 21/30*** | (2006.01) |
| ***H01Q 1/50*** | (2006.01) |
| ***H01Q 1/36*** | (2006.01) |
| ***H01Q 1/38*** | (2006.01) |
| ***H01Q 21/24*** | (2006.01) |

(52) U.S. Cl.

CPC ..... *H01Q 1/50* (2013.01); *H01Q 1/52* (2013.01); *H01Q 5/371* (2015.01); *H01Q 21/0006* (2013.01); *H01Q 21/0075* (2013.01); *H01Q 21/062* (2013.01); *H01Q 21/24* (2013.01); *H01Q 21/26* (2013.01); *H01Q 21/30* (2013.01)

BROADBAND DUAL-BAND BASE STATION ANTENNA ARRAY WITH HIGH OUT-OF-BAND ISOLATION

RELATED APPLICATIONS

This application is the U.S. National Phase of and claims priority to International Patent Application No. PCT/CN2017/111889, International Filing Date Nov. 20, 2017, entitled A Broadband Dual-Band Base Station Antenna Array With High Out-Of-Band Isolation; which claims benefit of Chinese Patent Application No. CN201710383966.1 filed May 26, 2017; both of which are incorporated herein by reference in their entireties.

TECHNICAL FIELD OF THE INVENTION

The invention relates to an antenna, more specifically to a broadband dual-band base station antenna array with high out-of-band isolation, which belongs to the field of mobile communication.

BACKGROUND OF THE INVENTION

With the rapid development of mobile communication technologies, it is often required in the construction of base station antenna arrays that the antenna array can not only cover multiple bands but also can support system with multiple wireless standards. When designing a dual-band or multi-band base station antenna arrays, especially broadband dual-band or multi-band antennas, the antennas usually have clutter outside the operating bands. These out-of-band clutter can cause serious coupling between different bands and can also seriously affect the antennas' pattern.

Traditional dual-band dual-polarized base station antenna arrays require cascade filters or combiners/duplexers for high out-of-band isolation. An invention patent application with publication number of CN 103036073, "Dual-band dual-polarized antenna", adopts a scheme with cascade combiner to realize the isolation of antennas between two different bands. However, it will bring additional losses and increase the size and design complexity of the antenna. Another solution is to use a filter antenna, which combines the radiator and filter. The utility model patent with publication number of CN 202076403 discloses a dual-band dual-polarized antenna array loading with a filter. A quarter-wavelength branch is introduced on the feeder to achieve suppression of different bands, but it is only suitable for narrowband applications, but not broadband. The invention patent application with publication number of CN 105720364A from South China University of Technology "a dual-polarized filter antenna with high selectivity and low cross-polarization" realizes a highly selective filter antenna without extra filtering Unit. However, its selectivity is for adjacent bands that are close to the operating band. When the two operating bands are far apart and the bandwidth is relatively wide, it is difficult to work. The above dual-band base station arrays are nested antenna with high and low frequency, so only two columns of antenna performance can be achieved.

SUMMARY OF THE INVENTION

The object of the present invention is to provide a broadband dual-band base station antenna array with high out-of-band isolation. The antenna array has a simple structure and overcomes the said shortcomings in the prior art including large coupling or too large floor in multi-band base stations and unstable pattern without introducing insertion losses such as filters.

The purpose of the present invention can be achieved by adopting the following technical solutions:

A broadband dual-band base station antenna array with high out-of-bandout-of-band isolation, comprising: at least one high-frequency antenna unit, one low-frequency antenna unit and a floor.

When there is one high-frequency antenna unit, it is placed on one side of the floor, and when there are multiple high-frequency antenna units, they are placed on both sides of the floor respectively; the high-frequency antenna unit includes multiple dipole arms and a balun, wherein the dipole arms are connected by a distributed inductor and fed through the balun.

The low-frequency antenna unit including multiple dipole arms and a balun is placed on the middle of the floor, wherein the dipole arms are connected by a distributed capacitor and are fed through the balun; the balun is provided with a feeder and a H-shape microstrip line, wherein the H-shape microstrip line connects with the feeder.

Preferably, the high-frequency antenna unit is a single-polarized antenna unit, and there are two dipole arms in the high-frequency antenna unit; the distributed inductor is a pair of microstrip bend line inductors, and two dipole arms connected by a pair of microstrip bend line inductors constitute a horizontally polarized dipole arm or a vertically polarized dipole arm.

Preferably, the high-frequency antenna unit is a dual-polarized antenna unit; there are four dipole arms in the high-frequency antenna unit and the distributed inductor is two pairs of microstrip bend line inductors; two of the dipole arms are connected by a pair of microstrip bend line inductors and constitute a −45 degree polarized arm; the other two dipole arms are connected by another pair of microstrip bend line inductors and constitute a +45 degree polarized arm; the two pairs of microstrip bend line inductors are cross-connected.

Preferably, a gap is left between two adjacent microstrip bend lines in the microstrip bend line inductors, and the microstrip bend line inductors are embedded between the dipole arms.

Preferably, the high-frequency antenna unit further comprises a dielectric board, the dipole arms and the distributed inductor are located in the same layer of the dielectric board.

Preferably, the low-frequency antenna unit is a single-polarized antenna unit, and there are two dipole arms in the low-frequency antenna unit which constitute a horizontally polarized dipole arm or a vertically polarized dipole arm; the distributed capacitor is a metal patch which is disposed in the middle of two dipole arms and is close to the two dipole arms without contact.

Preferably, the low-frequency antenna unit is a single-polarized antenna unit, wherein the low-frequency antenna unit is a dual-polarized antenna unit; there are four dipole arms in the low-frequency antenna unit, wherein two of the dipole arms constitute a −45 degree polarizer arm, and the other two dipole arms constitute a +45 degree polarizer arm; the distributed capacitor is a metal patch which is disposed in the middle of the four dipole arms and is close to the four dipole arms without contact.

Preferably, the metal patch is a disk-shaped structure, a cross-shaped structure, a rectangular structure or a quadrangular-star structure.

Preferably, the low-frequency antenna unit further comprises a dielectric board, the dipole arms are located on one layer of the dielectric board, and the distributed capacitor is on another layer of the dielectric board.

Preferably, the H-shape microstrip line is composed of a horizontal branch and two vertical branches, wherein the horizontal branch connects with the feeder, and the vertical branches connect with both ends of the horizontal branch and extent vertically along the feeder.

The present invention has the following beneficial effects with respect to the prior art:

1. The high-frequency antenna unit of the present invention connects the dipole arms with a distributed inductor, and utilizes the characteristics of inductive reactance, that is, short-circuit at low frequency and open-circuit at high frequency, to change the original resonant current path as well as control and suppress low-frequency clutter. The low-frequency antenna unit connects the dipole arms with a distributed capacitor. It utilizes the characteristics of capacitive reactance, that is, open-circuit at low frequency and short-circuit at high-frequency, together with the H-shape microstrip line to achieve regulation and suppression of high-frequency clutter. Then high isolation is achieved without cascading the filters in the case of short distance between antenna units with different frequency and small floor, thereby avoiding the filter insertion loss and achieving stable pattern in broadband. Meantime the decoupling structure does not add extra volume to the antenna unit.

2. The two filter antenna units of the present invention can be combined into a multi-row antenna array with promising circuit performance and matching performance of the antenna. The low-frequency antenna unit is placed on the middle of the floor. When there is one high-frequency antenna unit, it is placed on one side of the floor, and when there are multiple high-frequency antenna units, they are placed on both sides of the floor respectively. This arrangement can achieve good radiation performance, good matching and isolation characteristics with a small floor.

3. In the high-frequency antenna unit of the present invention, microstrip bend line inductors are used as the distributed inductor to suppress the spurious resonance of a single-polarized or dual-polarized antenna at low frequency. They increase the inductance and reduce the volume by bending. At the same time, a gap is left between the two adjacent microstrip bend lines on the microstrip bend line inductors to avoid contacting with each other and short-circuit, and the microstrip bend line inductors are convenient to be embedded between the dipole arms.

4. In the high-frequency antenna unit of the present invention, the distributed inductor and the dipole arms are located on the same layer of the dielectric board without affecting the polarization isolation of antenna, which avoids routing and vias on the lower layer of the dielectric board and is convenient for processing.

5. In the low-frequency antenna unit of the present invention, a metal patch is used as the distributed capacitor, which is located in the middle of the dipole arms and close to the dipole arms without electrical contact. Then the single-polarized or dual-polarized antenna dipole arms can be capacitively coupled and harmonic suppression can be further achieved without affecting polarization isolation.

6. In the low-frequency antenna unit of the present invention, the dipole arms are located on one of the layers of the dielectric board, and the distributed capacitor is located on another layer of the dielectric board. Therefore, it is convenient to adjust the capacitance of the connected dipole arms by changing the size of the metal patch. At the same time, it avoids short-circuit resulting from contact between the metal patch and the dipole arms. Then clutter can be controlled, the matching of the antenna can be improved, vias can be avoided and processing becomes convenient.

7. In the low-frequency antenna unit of the present invention, the horizontal branch of the H-shape microstrip line on the balun is connected to the feeder, and two vertical branches connect with both ends of the horizontal branch and extent vertically along the feeder. The H-shape microstrip line is integrated on the balun with a small volume, which has the advantages of miniaturization and easy processing; the H-shape microstrip line is characteristic for broadband harmonic suppression, which can suppress high-frequency harmonics from baluns. When cooperating with the metal patch, control and suppression of the overall high-frequency harmonics of the low-frequency antenna unit can be achieved by adjusting the connection position and the length of the two vertical branches. In addition, the H-shape microstrip line also becomes a part of the matching network to facilitate impedance matching of the antenna without occupying extra volume. The matching difference of the polarized arms caused by the different feeding positions can also be compensated by adjusting the position of the H-shape microstrip line.

Among them, 1—first high-frequency antenna unit, 2—second high-frequency antenna unit, 3—low-frequency antenna unit, 4—floor, 5—dielectric board, 6—first dipole arm, 7—second dipole arm, 8—third dipole arm, 9—fourth dipole arm, 10—first balun, 11—first microstrip bend line inductor, 12—second microstrip bend line inductor, 13—third microstrip bend line inductor, 14—fourth microstrip bend line inductor, 15—second dielectric board, 16—fifth dipole arm, 17—sixth dipole arm, 18—seventh dipole arm, 19—eighth dipole arm, 20—second balun, 21—metal patch, 22—feeder, 23—H microstrip line, 24—horizontal branch, 25—first vertical branch, 26—second vertical branch.

DETAILED DESCRIPTION WITH REFERENCE TO THE DRAWINGS

The following embodiments clearly describes the technical solutions of the present invention with reference to the accompanying drawings. The described embodiments are merely a part of the embodiments of the present invention. All other embodiments obtained by a person skilled in the art without making creative efforts in the embodiments of the present invention shall fall within the protection scope of the present invention.

Embodiment 1

As shown in FIG. 1 to FIG. 5, this embodiment provides a broadband dual-band base station antenna array with high out-of-bandout-of-band isolation including a first high-frequency antenna unit 1, a second high-frequency antenna unit 2, a low-frequency antenna unit 3 and the floor 4, i.e., the embodiment is a three-row antenna array. As can be seen from FIG. 1 and FIG. 2, three antenna units are all placed on the floor 4 and are located on the same horizontal plane. The first high-frequency antenna unit 1 and the second high-frequency antenna unit 2 are respectively placed on both sides of the floor 4, while the low-frequency antenna unit 3 is placed in the middle of the floor 4. This arrangement can achieve good radiation performance as well as good matching and isolation characteristics with a small floor. Because of the difference in frequency, the heights of the dipole arms of the three antenna units are also different. The middle low-frequency antenna unit 3 is relatively higher due to its low frequency, and the first high-frequency antenna unit 1 and the second high-frequency antenna unit 2 on both sides are relatively lower due to their high frequency; the first high-frequency antenna unit 1, the second high-frequency antenna unit 2 and the low-frequency antenna unit 3 are all dual-polarized antenna units.

Figure 1:
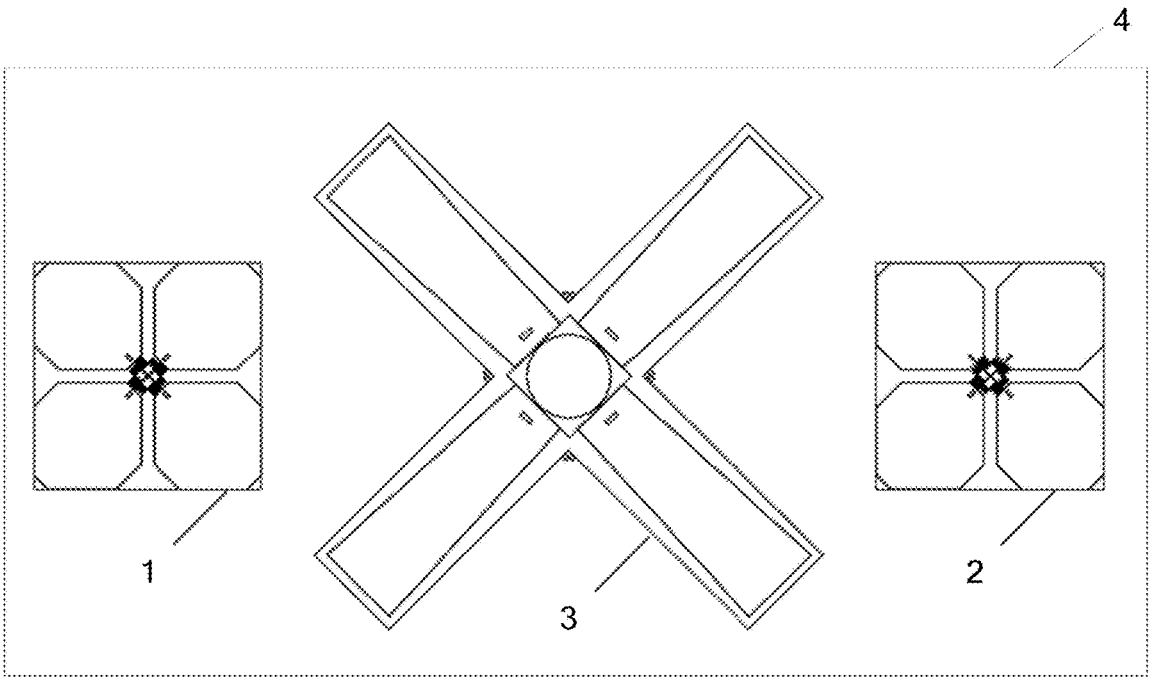
FIG. 1 is a top view of a broadband dual-band dual-polarized base station antenna array with high out-of-band-out-of-band isolation according to a first embodiment of the present invention.
Figure 2:
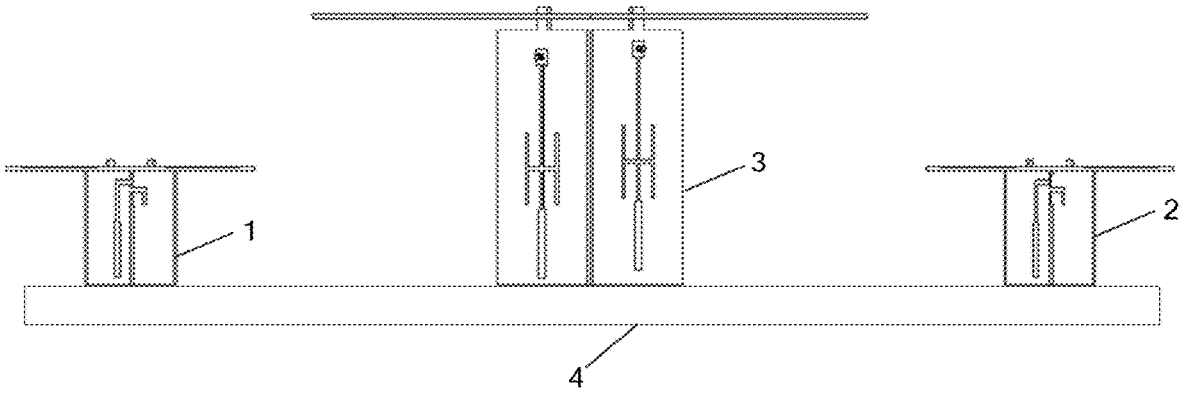
FIG. 2 is a front structural view of a broadband dual-band dual-polarized base station antenna array with high out-of-bandout-of-band isolation according to a first embodiment of the present invention.
Figure 3:
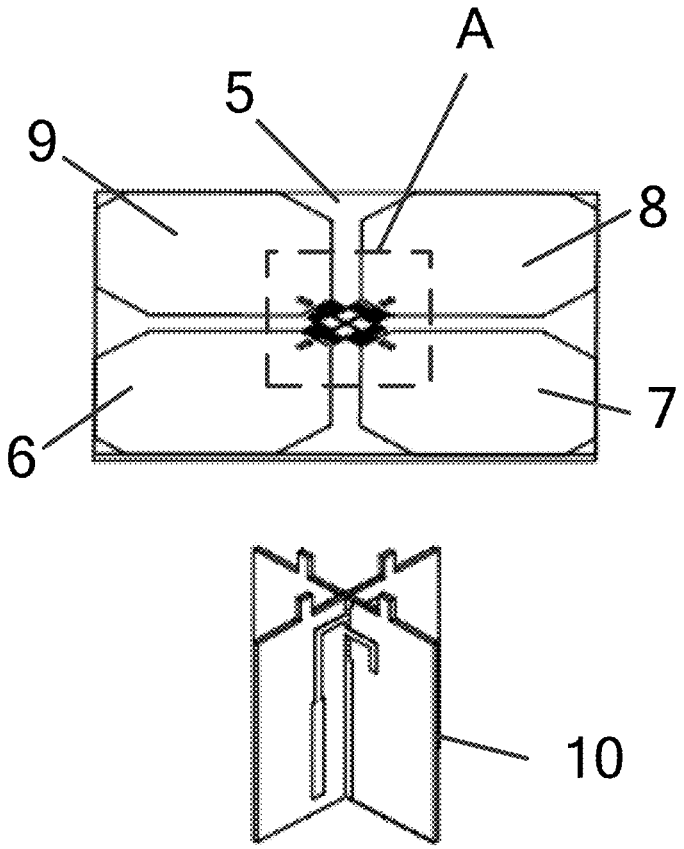
FIG. 3 is a three-dimensional exploded structural diagram of the high-frequency antenna unit in a broadband dual-band dual-polarized base station antenna array with high out-of-bandout-of-band isolation according to a first embodiment of the present invention.
Figure 4:
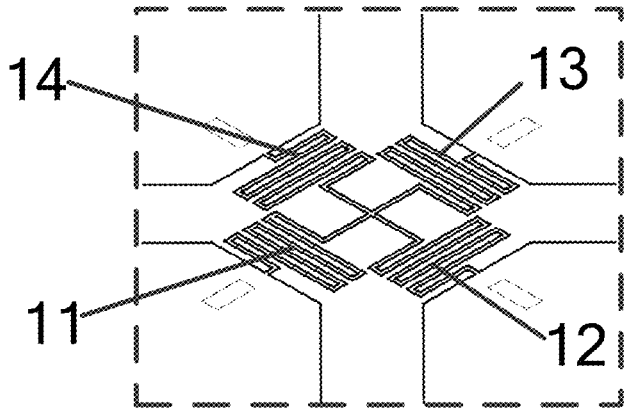
FIG. 4 is an enlarged view of A in FIG. 3.
Figure 5:
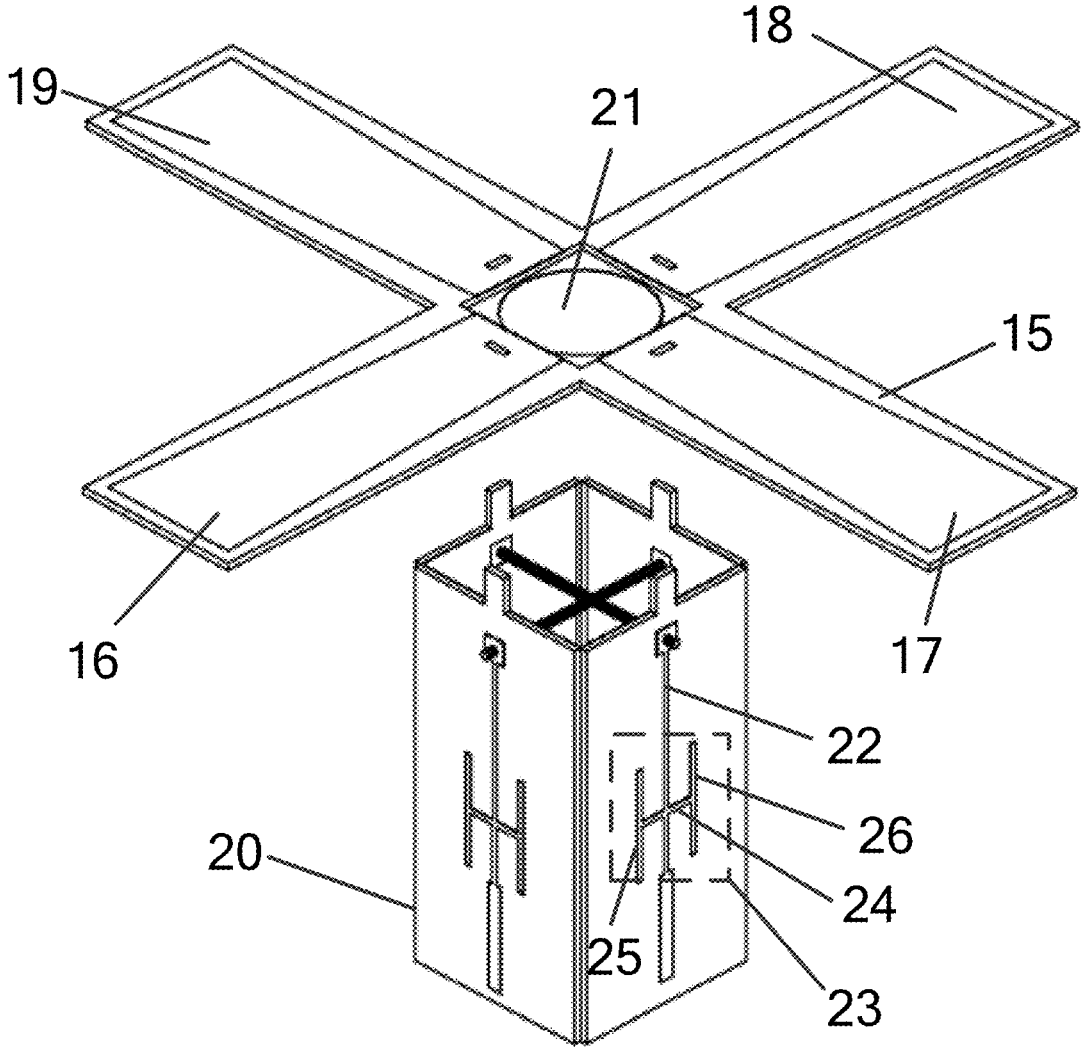
FIG. 5 is a three-dimensional exploded structural diagram of a low-frequency antenna unit in a broadband dual-band dual-polarized base station antenna array with high out-of-bandout-of-band isolation according to a first embodiment of the present invention.

The first high-frequency antenna unit 1 and the second high-frequency antenna unit 2 operates at a high-frequency band (e.g., 1710-2690 MHz) and have the same size of a structure. One of the high-frequency antenna units is taken as an example. As shown in FIG. 3 and FIG. 4, it includes the first dielectric board 5, the first dipole arm 6, the second dipole arm 7, the third dipole arm 8, the fourth dipole arm 9, and the first balun 10, wherein the four dipole arms are connected by a distributed inductor and fed through the first balun 10. The first balun 10 is a dual-polarized balun, and the distributed inductor is two pairs of microstrip bend line inductors, that is, four microstrip bend line inductors, which are respectively a first microstrip bend line inductor 11, a second microstrip bend line inductor 12, a third microstrip bend line inductor 13 and a fourth microstrip bend line inductor 14.

In this embodiment, the first dipole arm 6 and the third dipole arm 8 constitute a −45 degree polarizer arm; the first microstrip bend line inductor 11 and the third microstrip bend line inductor 13 constitute a pair of microstrip bend line inductor which is connected to the −45 degree polarized arm to suppress the spurious resonance of the −45 degree polarized antenna at low frequency. The second dipole arm 7 and the fourth dipole arm 9 constitute a +45 degree polarized arm; the second microstrip bend line inductor 12 and the fourth microstrip bend line inductor 14 are connected to the +45 degree polarized dipole arm, which can suppress the spurious resonance of the +45 degree polarized antenna at low frequency. Thus, the first high-frequency antenna unit 1 and the second high-frequency antenna unit 2 can independently realize filtering with ±45 degree polarization; the four microstrip bend line inductors increase the inductance and reduce the volume by bending. At the same time, there is a gap between the two adjacent microstrip bend lines on the microstrip bend line inductors to avoid contacting with each other and short-circuit, so that the microstrip bend line inductors are convenient to be embedded between the dipole arms.

The two pairs of microstrip bend line inductors can be cross-connected without additional vias. At the same time, two pairs of microstrip bend line inductors and ±45 degree polarized arms are located on the same layer of the first dielectric board 5. The structure in this embodiment is all located on the upper layer of the first dielectric board 5, which does not affect the isolation of the two ±45 degree polarized dipole arms of the antenna, avoids routing and vias on the lower layer of the dielectric board and is convenient for processing.

From the above, it can be seen that the high-frequency antenna unit of the present embodiment connects the four dipole arms through two pairs of microstrip bend line inductors, and utilizes the characteristics of inductive reactance, that is, short-circuit at the low-frequency and open-circuit at high-frequency, to change the original resonant current path as well as control and suppress low-frequency noise.

The low-frequency antenna unit 3 operates at a low-frequency band (eg, 690-960 MHz) lower than the operating bands of the two high-frequency antenna units. As can be seen from FIG. 5, it includes the second dielectric board 15, the fifth dipole arm 16, the sixth dipole arm 17, the seventh dipole arm 18, the eighth dipole arm 19 and the second balun 20. The fifth dipole arm 16, the sixth dipole arm 17, the seventh dipole arm 18 and the eighth dipole arm 19 are connected by a distributed capacitor and fed through the second balun 20, wherein the distributed capacitor is a metal patch 21.

In this embodiment, the fifth dipole arm 16 and the seventh dipole arm 18 constitute a −45 degree polarized arm, the sixth dipole arm 17 and the eighth dipole arm 19 constitute a +45 degree polarized arm. The metal patch 21 has a disc-shaped structure, and it is arranged in the middle of the four dipole arms. Meantime it is close to the four dipole arms without contact, which can realize capacitive coupling between the ±45 degree polarized arms and achieve harmonic suppression without affecting polarization isolation.

The ±45 degree polarized arms are located on one layer of the second dielectric board 15, and the disc-shaped structure is located on another layer of the second dielectric board 15. The ±45 degree polarized arms of this embodiment are located on the upper layer of the second dielectric board 15 and the disc-shaped structure is located on the lower layer of the second dielectric board 15, so that it is convenient to adjust the capacitance of the connected dipole arms by changing the size of the disc-shaped structure. At the same time, it avoids short-circuit resulting from contact between the disc-shaped structure and the dipole arms. Then clutter can be controlled, the matching of the antenna can be improved, vias can be avoided, and processing becomes convenient.

The second balun 20 is a dual-polarized balun having four faces, a feeder 22 and an H-type microstrip line 23 are arranged on any of the two adjacent faces. The H-type microstrip line 23 consists of a horizontal branch 24, the first vertical branch 25 and the second vertical branch 26. The horizontal branch 24 is connected to the feeder 22, while the first vertical branch 25 and the second vertical branch 26 are connected to both ends of the horizontal branch and extent vertically along the feeder 22. The H-shape microstrip line 23 is integrated on the second balun 20 with a small volume, which has the advantages of miniaturization and easy processing; the H-shape microstrip line 23 is characteristic for broadband harmonic suppression, which can suppress high-frequency harmonics from baluns. When cooperating with the disc-shaped structure, control and suppression of the overall high-frequency harmonics of the low-frequency antenna unit 3 can be achieved by adjusting the connection position and the length of the two vertical branches. In addition, the H-shape microstrip line also becomes a part of the matching network to facilitate impedance matching of the antenna without occupying extra volume. The matching difference of the ±45 degree polarized arms of the low-frequency antenna unit 3 caused by the different feeding positions can also be compensated by adjusting the position of the H-shape microstrip line 23.

From the above, it can be seen that the low-frequency antenna unit 3 of the present embodiment connects the four dipole arms through a disc-shaped structure. It utilizes the characteristics of capacitive reactance, that is, open-circuit at low frequency and short-circuit at high-frequency, together with the H-shape microstrip line 23 on the second balun 20 to achieve regulation and suppression of high-frequency clutter.

Figure 6:
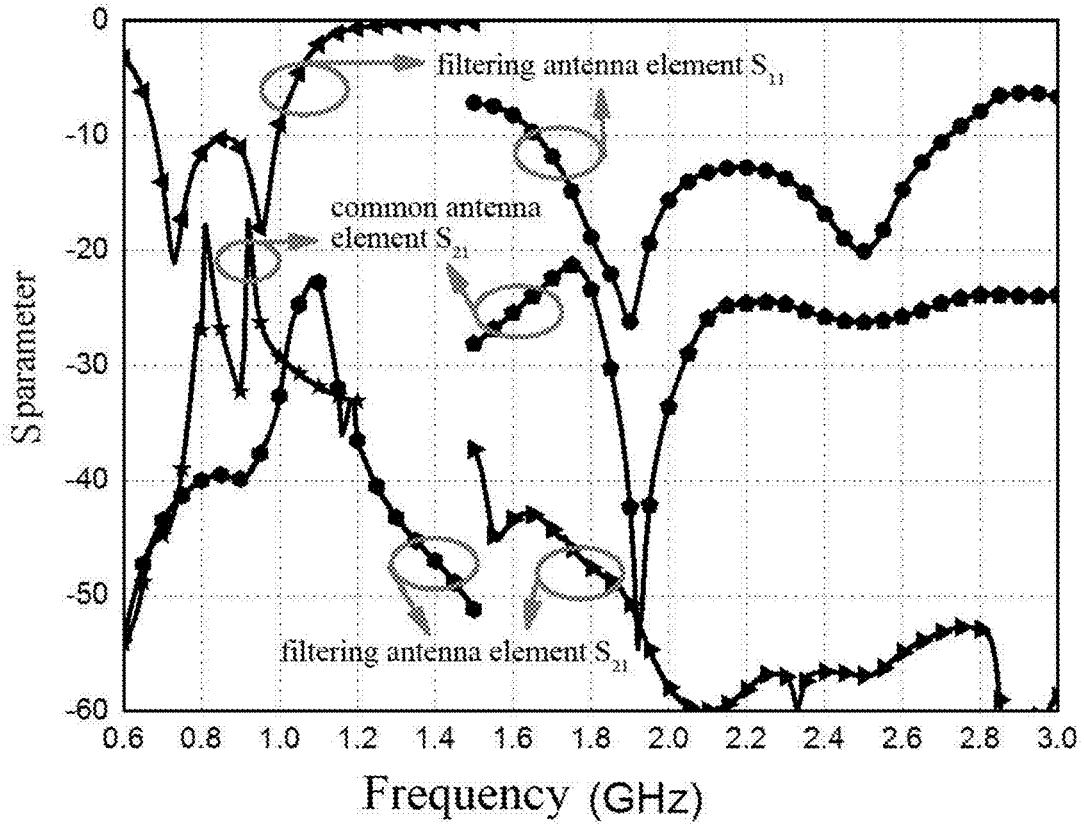
FIG. 6 is an S-parameter curve of a broadband dual-band dual-polarized base station antenna array with high out-of-bandout-of-band isolation according to a first embodiment of the present invention.

This embodiment provides harmonic suppression of over 40% of the bandwidth. Without the cascade of filters, high isolation is achieved with a short distance between antenna units having different frequencies and small floor. This avoids insertion loss from filters, meantime achieves a stable pattern in broadband, and the decoupling structure does not additionally increase the volume of the antenna unit; due to the good clutter suppression performance, in the present embodiment, The spacing between two high-frequency antenna units and the low frequency the antenna unit is only 100 mm, and the width of the floor 4 is 280 mm, which is enough to guarantee good isolation and radiation performance. FIG. 6 is an S-parameter curve of a broadband dual-band base station antenna array with high out-of-bandout-of-band isolation according to a first embodiment of the present invention.

FIG. 6 is an S-parameter curve of a broadband dual-band base station antenna array with high out-of-bandout-of-band isolation according to the present embodiment. It can be seen that after the high-frequency clutter of the low-frequency (690-960 MHz) antenna unit has been suppressed, the coupling of the high-frequency antenna unit in the 1710-2690 MHz band is reduced to below −40 dB, which improves more than 30 dB compared with the normal array. After the low-frequency clutter of the high-frequency (1710-2690 MHz) antenna unit has been suppressed, the coupling of the low-frequency antenna unit in the 690-960 MHz band is reduced to below −30 dB, which improves more than 20 dB compared with the conventional array.

Figure 7:
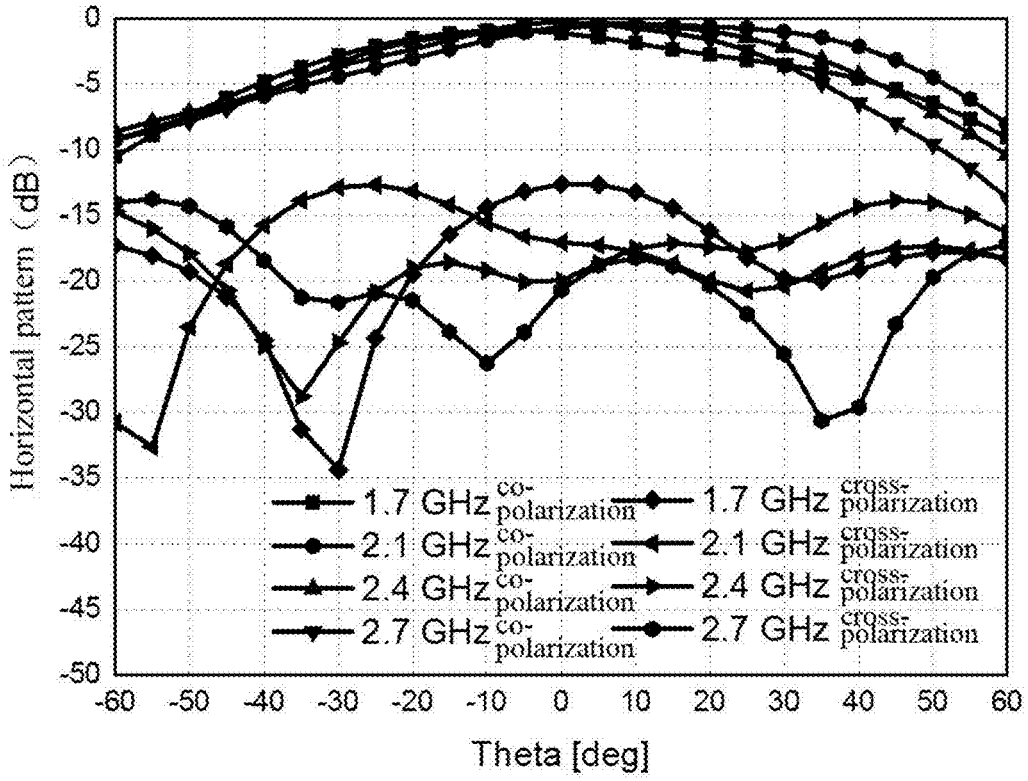
FIG. 7 is the simulation result of the high-frequency pattern in horizontal direction of a broadband dual-band dual-polarized base station antenna array with high out-of-bandout-of-band isolation according to a first embodiment of the present invention.

FIG. 7 is the high-frequency pattern in horizontal direction of a harmonic suppressing broadband dual-band base station antenna array with high out-of-bandout-of-band isolation provided by an embodiment of the present invention, and four representative values in 1710-2690 MHz are selected. It can be seen that the 10 dB lobe basically meets the lobe width requirement of 120 degrees, and the 3 dB lobe width is within 56-71 degree. In addition, the cross polarization at 0 degree is greater than 12 dB, and the cross polarization at ±60 degrees is greater than 8 dB.

Figure 8:
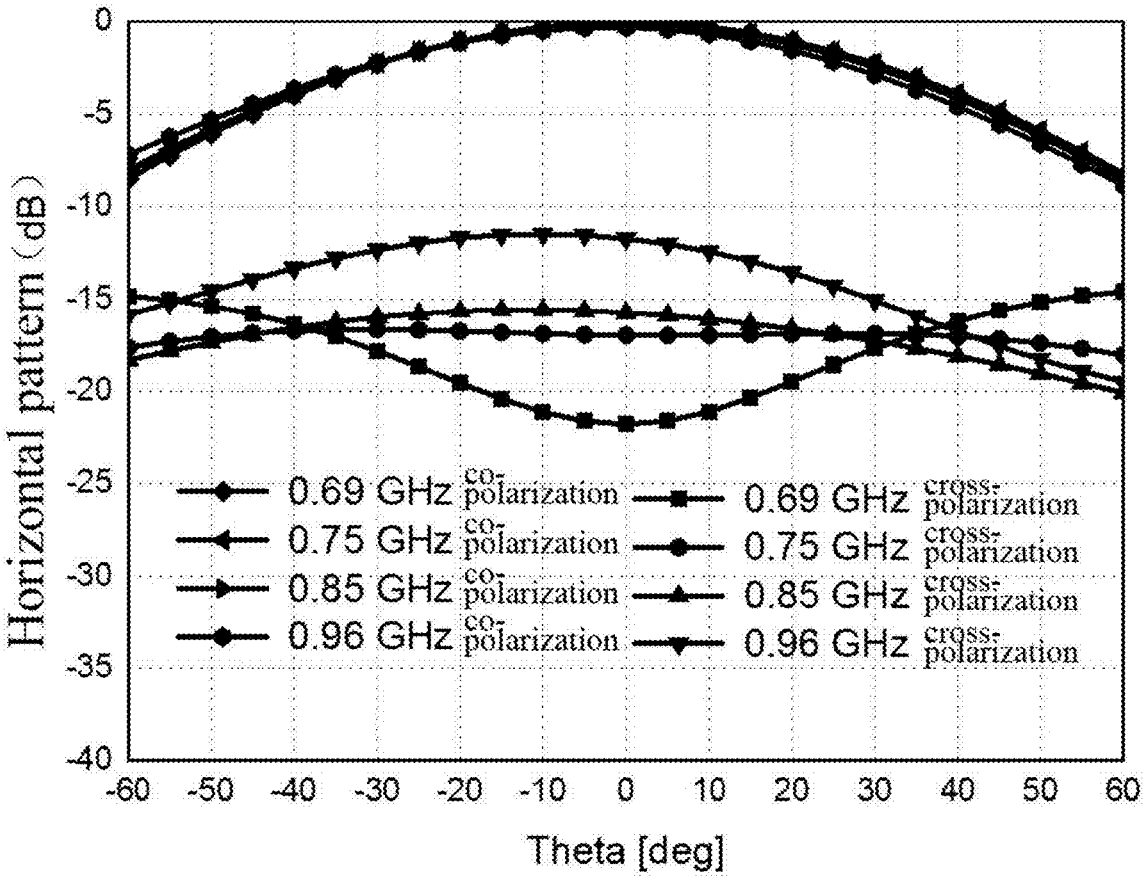
FIG. 8 is the simulation result of the low-frequency pattern in horizontal direction of a broadband dual-band dual-polarized base station antenna array with high out-of-bandout-of-band isolation according to a first embodiment of the present invention.

FIG. 8 is the low-frequency pattern in a horizontal direction of a harmonic suppressing broadband dual-band base station antenna array with high out-of-bandout-of-band isolation provided by an embodiment of the present invention, and four representative values in 690-960 MHz are selected. It can be seen that the 10 dB lobe basically meets the lobe width requirement of 120 degrees, and the 3 dB lobe width is within 64-71 degree. In addition, the cross polarization at 0 degree is greater than 12 dB, and the cross polarization at ±60 degrees is greater than 8 dB.

This embodiment has the following advantages:

1) The spacing among the filter antenna units is small, which is only 100 mm away from each other; the floor is small and is only 280 mm, which is a relatively high level in the current industry;

2) The antenna array is suitable for bands in 690-960 MHz and 1710-2690 MHz, and can suppress more than 40% of the clutter. Moreover, the couplings of high-frequency and low-frequency antenna units are below −30 dB.

3) Occupying a small volume, the antenna unit has no distortion in the pattern and basically satisfies the requirements of the pattern for base station.

4) It is easy to manufacture, convenient to assembly without extra circuit loading.

Embodiment 2

Figure 9:
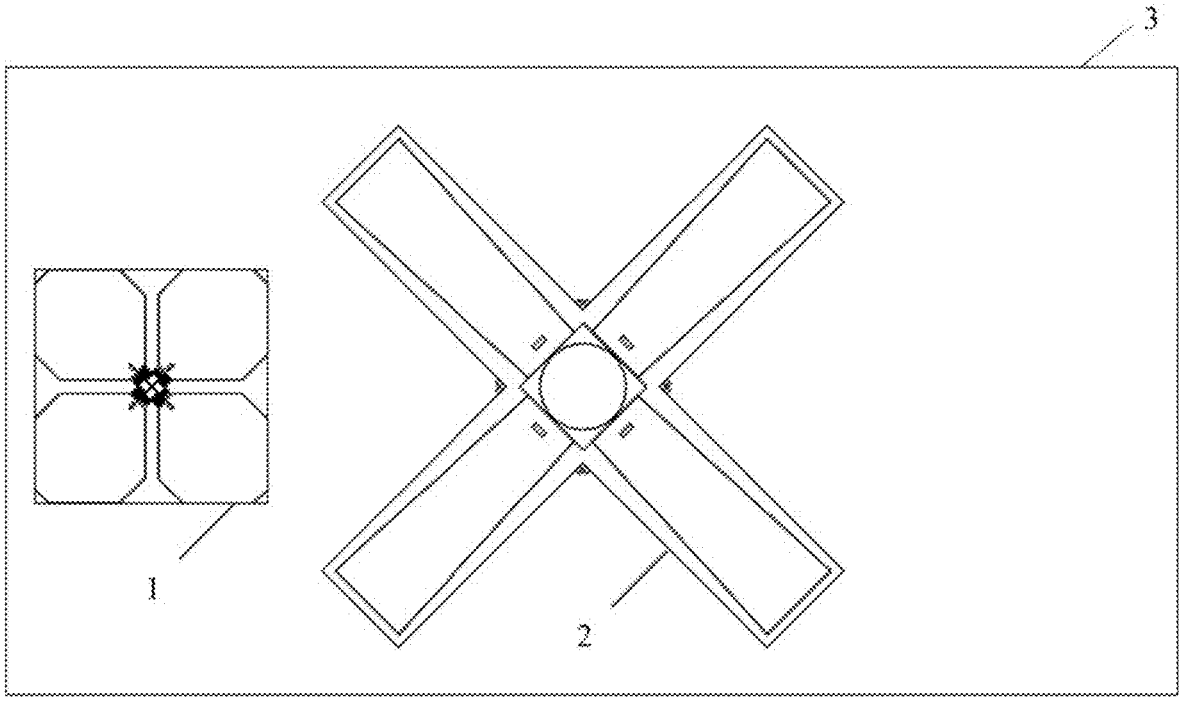
FIG. 9 is a top view of a broadband dual-band dual-polarized base station antenna array with high out-of-band-out-of-band isolation according to a second embodiment of the present invention.

As shown in FIG. 9, a harmonic suppressing broadband dual-band base station antenna array with high out-of-bandout-of-band isolation of this embodiment includes a high-frequency antenna unit 1, a low-frequency antenna unit 2 and a floor 3, that is, the present embodiment is a two-row antenna array. Two antenna units are placed on the floor 3 and are located on the same horizontal plane. The high-frequency antenna unit 1 is placed on one side of the floor 3, and the low-frequency antenna unit 2 is placed in the middle of the floor 3. The high-frequency antenna unit 1 and the low-frequency antenna unit 2 of the present embodiment are both dual-polarized antenna units, and the specific structure thereof is the same as that of the first embodiment.

Embodiment 3

A broadband dual-band single-polarized base station antenna array with high out-of-bandout-of-band isolation is provided by this embodiment, wherein the first high-frequency antenna unit 1 and the second high-frequency antenna unit 2 are single-polarized antenna units, i.e., there are two dipole arms. The distributed inductor is a pair of microstrip bend line inductors, and two dipole arms constitute a horizontal-polarized dipole arm or a vertical-polarized dipole arm, and two dipole arms are connected by a pair of microstrip bend line inductors; similarly, the low-frequency antenna unit 3 is a dual-polarized antenna unit, that is, there are two dipole arms, and two dipole arms constitute a horizontally polarized dipole arm or a vertically polarized dipole arm; the distributed capacitor is a metal patch, which is disposed in the middle of the two dipole arms and is close to the two dipole arms without contact; the first balun and the second balun are single-polarized baluns, wherein a feeder and an H-type microstrip line 23 is provided on one of the faces of the second balun 22. The rest is the same as in Example 1.

Embodiment 4

The main features of this embodiment are: the first high-frequency antenna unit 1 and the second high-frequency antenna unit 2 are single-polarized antenna units, the low-frequency antenna unit 3 is a dual-polarized antenna unit; or the first high-frequency antenna unit 1 and the second high-frequency antenna unit 2 are dual polarized antenna units, and the low-frequency antenna unit 3 is a single-polarized antenna unit. The rest is the same as in Example 1.

In summary, the present invention is applicable to the field of wireless mobile communication base stations and can be applied to receiving and transmitting devices of various types of wireless communication systems. Due to the filtering characteristics of the present invention, it is particularly suitable for base station antennas operating at 690-960 MHz and 1710-2690 MHz in open and complex multi-band multi-standard communication environments. At the same time, due to the combination of filtering and radiation characteristics, the present invention is also applicable to the integration of wireless mobile communication system devices, reducing requirements for design, and improving the anti-interfering performance of communication devices.

The above description is only the preferred embodiments of the present invention, but the protection scope of the present invention is not limited to this. For example, the antenna array may also be an array of four or more antennas, and the microstrip bend line inductor may also be replaced by other Similar inductors. Metal patches can also be cross-shaped structures, rectangular structures, four-pointed star structure and other shapes. The equivalent replacement or change of the inventive concept within the scope of the invention by any person skilled in the art still belongs to the protection scope of the present invention.

What is claimed is:

1. A broadband dual-band base station antenna array with high out-of-band isolation, wherein it comprises at least one high-frequency antenna unit, one low-frequency antenna unit, and a floor;

when there is one high-frequency antenna unit, it is placed on one side of the floor, and when there are multiple high-frequency antenna units, they are placed on both sides of the floor respectively; the high-frequency antenna unit includes multiple dipole arms and a balun, wherein the dipole arms are connected by a distributed inductor and fed through the balun;

the low-frequency antenna unit including multiple dipole arms and a balun is placed on the middle of the floor, wherein the dipole arms are connected by a distributed capacitor and are fed through the balun; the balun is provided with a feeder and a H-shape microstrip line, wherein the H-shape microstrip line connects with the feeder;

wherein the low-frequency antenna unit is a dual-polarized antenna unit, there are four dipole arms of the same length in the low-frequency antenna unit, wherein two of the dipole arms constitute a −45 degree polarizer arm, and the other two dipole arms constitute a +45 degree polarizer arm; the distributed capacitor is a metal patch which is disposed in the middle of the four dipole arms and is close to the four dipole arms without contact.

2. The broadband dual-band base station antenna array with high out-of-band isolation as claimed in claim 1, wherein the high-frequency antenna unit is a single-polarized antenna unit, and there are two dipole arms in the high-frequency antenna unit; the distributed inductor is a pair of microstrip bend line inductors, and two dipole arms connected by a pair of microstrip bend line inductors constitute a horizontally polarized dipole arm or a vertically polarized dipole arm.

3. The base station antenna array as claimed in claim 2, wherein there is a gap between two adjacent microstrip bend lines in the microstrip bend line inductors, and the microstrip bend line inductors are embedded between the dipole arms.

4. The broadband dual-band base station antenna array with high out-of-band isolation as claimed in claim 1, wherein the high-frequency antenna unit is a dual-polarized antenna unit; there are four dipole arms in the high-frequency antenna unit and the distributed inductor is two pairs of microstrip bend line inductors; two of the dipole arms constitute a −45 degree polarized arm which is connected by a pair of microstrip bend line inductors and; the other two dipole arms constitute a +45 degree polarized arm which is connected by another pair of microstrip bend line inductors and; the two pairs of microstrip bend line inductors are cross-connected.

5. The base station antenna array as claimed in claim 1, wherein the high-frequency antenna unit further comprises a dielectric board, the dipole arms and the distributed inductor are located in the same layer of the dielectric board.

6. The base station antenna array as claimed in claim 1, wherein the metal patch is a disk-shaped structure, a cross-shaped structure, a rectangular structure or a quadrangular-star structure.

7. The base station antenna array as claimed in claim 1, wherein the low-frequency antenna unit further comprises a dielectric board, the dipole arms are located on one layer of the dielectric board, and the distributed capacitor is on another layer of the dielectric board.

8. The base station antenna array as claimed in claim 1, wherein the H-shape microstrip line is composed of a horizontal branch and two vertical branches, the horizontal branch connects with the feeder and the vertical branches connect with both ends of the horizontal branch and extent vertically along the feeder.

9. The base station antenna array as claimed in claim 1, wherein the one high-frequency antenna unit or the multiple high-frequency antenna units are placed between two perpendicular arms of the four dipole arms.

* * * * *